US006491293B1

(12) United States Patent
Brewer

(10) Patent No.: US 6,491,293 B1
(45) Date of Patent: Dec. 10, 2002

(54) ROTATABLE ENGINE HOLDING ASSEMBLY

(76) Inventor: Michael L. Brewer, P.O. Box 668, Kearny, AZ (US) 85237

( * ) Notice: Subject to any disclaimer, the term of this patent is extended or adjusted under 35 U.S.C. 154(b) by 0 days.

(21) Appl. No.: 10/071,646

(22) Filed: Feb. 8, 2002

(51) Int. Cl.[7] ..... B25B 1/00
(52) U.S. Cl. ..... 269/17; 269/47
(58) Field of Search ..... 269/17, 47, 8 B, 269/8 R, 7 B, 7 R, 4 B, 4 R, 52; 188/1.12, 29, 74, 83; 16/35 R, 42 R, 42 T, 43, 39

(56) References Cited

U.S. PATENT DOCUMENTS 3,381,953 A 5/1968 Miller
3,675,914 A 7/1972 Douglass
3,734,466 A * 5/1973 Mason ..... 254/89
3,765,667 A 10/1973 Christiansen
4,118,010 A * 10/1978 Hanscom ..... 254/124
4,239,196 A 12/1980 Hanger
4,533,127 A 8/1985 Hawkins
4,691,904 A * 9/1987 Armstrong ..... 269/17
D324,599 S 3/1992 Bailey
6,431,535 B1 * 8/2002 Volpe ..... 269/47

* cited by examiner

*Primary Examiner*—Joseph J. Hail, III
*Assistant Examiner*—Daniel Shanley

(57) ABSTRACT

A rotatable engine holding assembly for permitting rotation of an engine while the engine is being held above a support surface. The rotatable engine holding assembly includes a support frame having an attachment assembly couplable to an engine block to hold the engine. The assembly includes a rotatable axle coupling the attachment assembly to the support frame to permit rotation of the engine while the engine is being held.

7 Claims, 3 Drawing Sheets

ROTATABLE ENGINE HOLDING ASSEMBLY

BACKGROUND OF THE INVENTION

1. Field of the Invention

The present invention relates to engine stands and more particularly pertains to a new rotatable engine holding assembly for permitting rotation of an engine while the engine is being held above a support surface.

2. Description of the Prior Art

The use of engine stands is known in the prior art. U.S. Pat. No. 4,239,196 describes an engine stand having a tilt mechanism and a crank handle driven rotatable face plate. Another type of engine stand is U.S. Pat. No. 3,675,914 having a weighted wheel and spoke arrangement to permit rotation of an engine. U.S. Pat. No. 3,381,953 discloses a non-rotatable portable engine stand. U.S. Pat. No. 3,765,667 shows another engine stand that provides tilting and rotation of the engine. U.S. Pat. No. 4,533,127 shows a wheel arrangement for an engine stand. U.S. Pat. No. Des. 324,599 discloses an ornamental appearance for an engine stand.

While these devices fulfill their respective, particular objectives and requirements, the need remains for an engine stand that includes a ratcheting mechanism typically utilized in slack adjusters for rotating an engine in a more precise and easier manner.

SUMMARY OF THE INVENTION

The present invention meets the needs presented above by utilizing a slack adjuster ratchet mechanism coupled to an S-cam shaft fixed to an engine mount plate.

Still yet another object of the present invention is to provide a new rotatable engine holding assembly that permits wheeling of an engine on a support surface.

Even still another object of the present invention is to provide a new rotatable engine holding assembly that precise rotation of an engine to a desired position.

Yet another object of the invention is to provide an engine stand that is capable of attachment to a variety of engine types by utilizing an adjustable mounting plate assembly.

To this end, the present invention generally comprises a support frame having an attachment assembly couplable to an engine block to hold the engine. The assembly includes a rotatable axle coupling the attachment assembly to the support frame to permit rotation of the eninge while the engine is being held.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
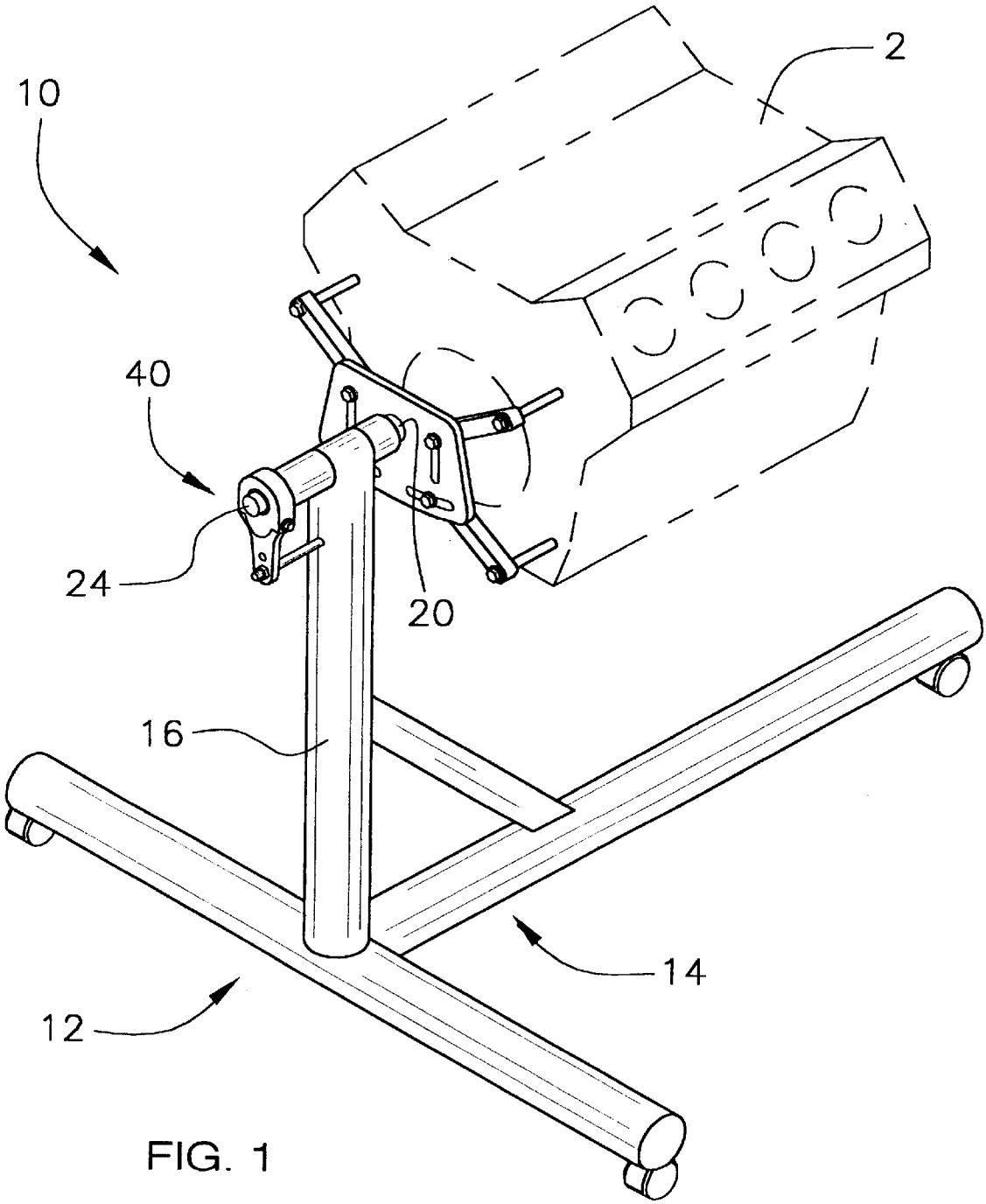
FIG. 1 is a perspective view of a new rotatable engine holding assembly according to the present invention.
Figure 2:
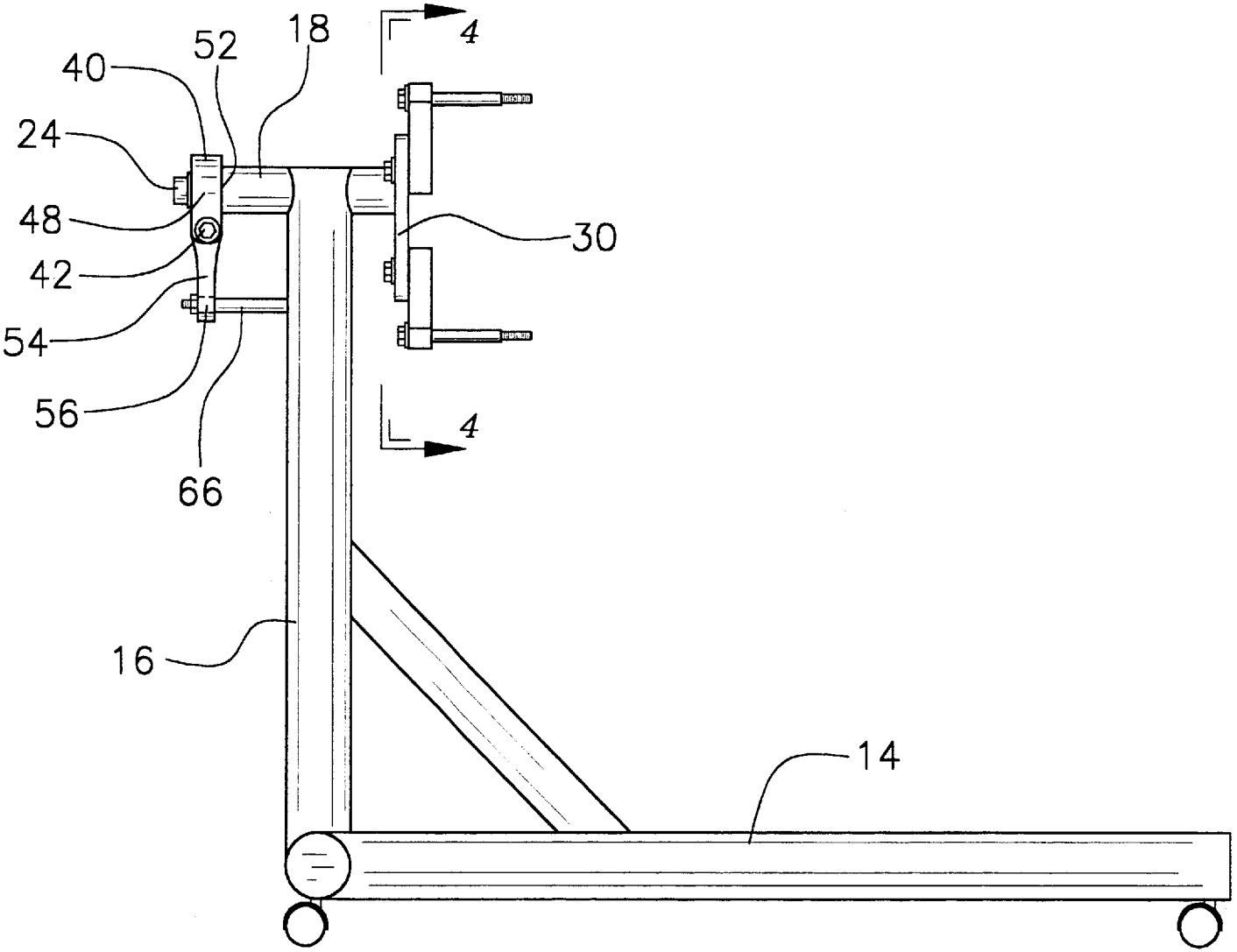
FIG. 2 is a side view of the present invention.
Figure 3:
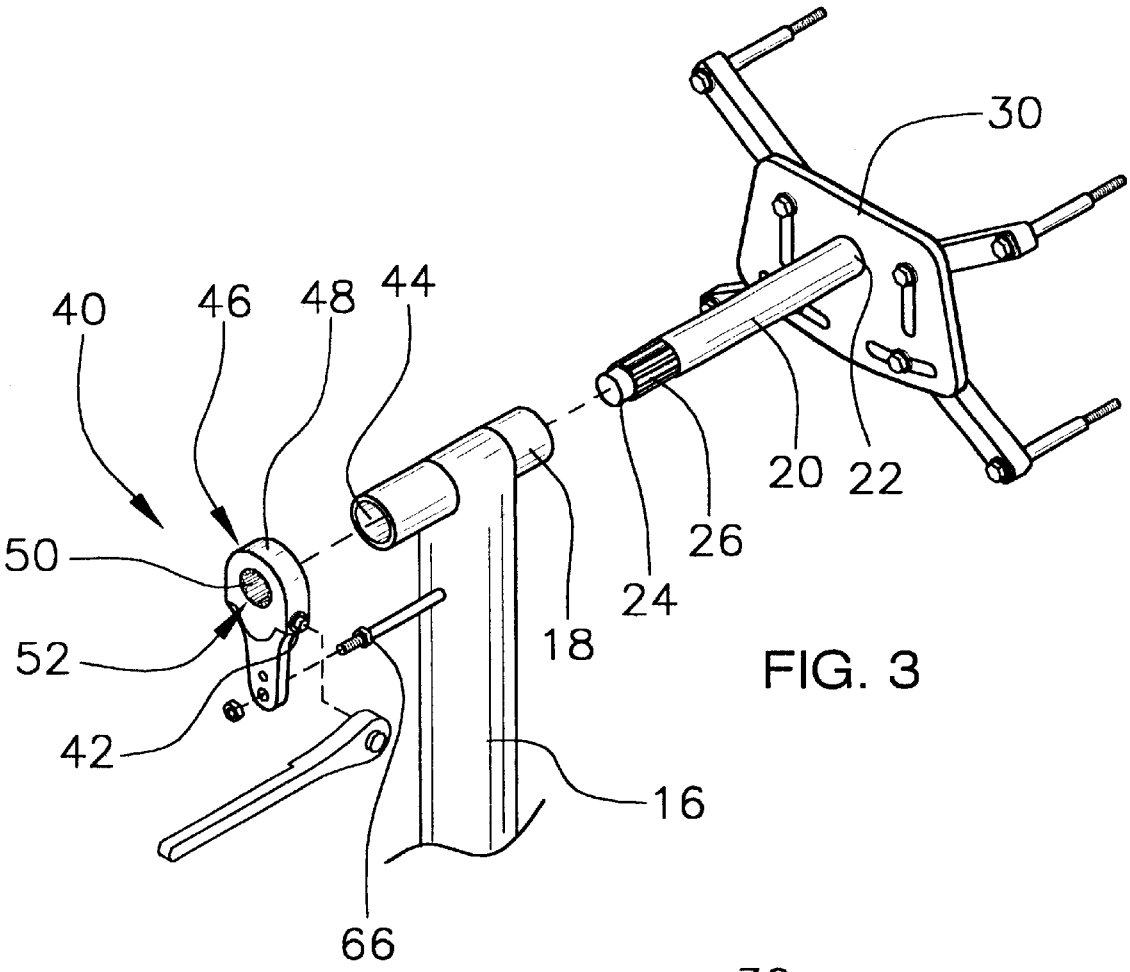
FIG. 3 is a an exploded view of the present invention.
Figure 4:
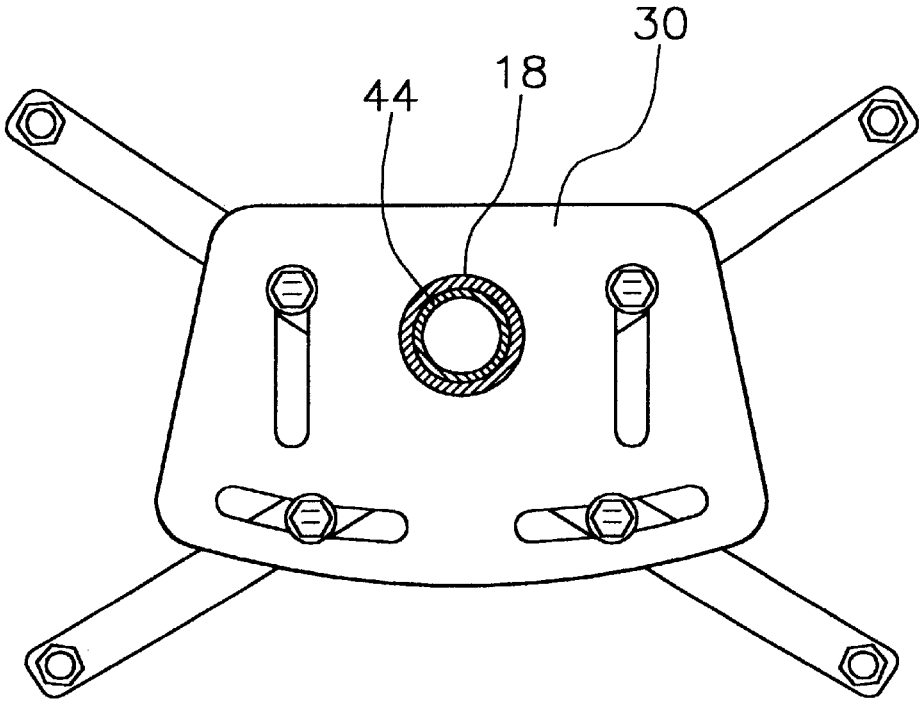
FIG. 4 is a front view of the mounting plate assembly of the present invention.

With reference now to the drawings, and in particular to FIGS. 1 through 4 thereof, a new rotatable engine holding assembly embodying the principles and concepts of the present invention and generally designated by the reference numeral 10 will be described.

As best illustrated in FIGS. 1 through 4, the rotatable engine holding assembly 10 generally comprises a support stand 12 having a wheeled base 14 and a vertical upright member 16. An axle 20 extends through an upper portion of the vertical upright member 16. The axle 20 has a first end 22 and a second end 24. The axle 20 has a plurality of teeth 26 extending inwardly from the second end 24 of the axle 20.

An adjustable mounting plate assembly 30 of a generally conventional design is provided for coupling to an engine 2. The mounting plate assembly 30 is fixedly coupled to the first end 22 of the axle 20. Thus, the mounting plate assembly 30 rotates when the axle 20 is rotated. The axle and mounting plate assembly can be constructed by welding an S-cam shaft to an existing mounting plate assembly.

A ratchet mechanism 40 is fixedly coupled to the vertical upright member 16. The ratchet mechanism 40 engages the plurality of teeth 26. Thus, the axle 20 rotates when the ratchet mechanism 40 is operated as described more fully below. The ratchet mechanism 40 has an adjuster nut 42 rotatable for operating the ratchet mechanism 40.

The adjuster nut 42 is rotatable in a first direction for rotating the mounting plate assembly 30 in a clockwise direction and in a second direction for rotating the mounting plate assembly 30 in a counter-clockwise direction.

The ratchet assembly 40 includes a housing 46. The housing 46 includes a main portion 48. The ratchet assembly 40 includes a toothed rotatable ring 50 positioned in the main portion 48 of the housing 46. The adjuster nut 42 is operationally coupled to the toothed rotatable ring 50.

The axle 20 extends through an aligned pair of holes 52 in the main portion 48 of the housing 46 such that the teeth 26 are engaged by the toothed rotatable ring 50.

The vertical upright member 16 has a transverse tubular portion 18. The axle 20 passes through the transverse tubular portion 18. A pair of bushings 44 are positioned in the transverse tubular portion 18 of the vertical upright member 16.

The housing 46 has an arm portion 54 that extends from the main portion 48. The arm portion 54 has an aperture 56 that extends through the arm portion 54. A bolt member 66 is insertable through the aperture 56 and engaged to the vertical upright member 16. The aperture 56 is offset from the transverse tubular portion 18 of the vertical upright member 16 when the ratchet assembly 40 is coupled to the axle 20. Thus, the bolt member 66 holds the housing 46 in a static position relative to the upright vertical member 16. The entire ratchet assembly is thus held to the vertical upright member only by the bolt member to permit easy replacement of the ratchet assembly.

The adjuster nut 42 is positioned on a side of the main portion 48 of the housing 46 to permit easy access using a ratcheting tool.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An engine stand comprising:

a support stand having a wheeled base and a vertical upright member;

an axle extending through an upper portion of said vertical upright member, said axle having a first end and a second end;

said axle having a plurality of teeth extending along a portion of said axle, said teeth extending inwardly from said second end of said axle;

an adjustable mounting plate assembly adapted for coupling to an engine, said mounting plate assembly being fixedly coupled to said first end of said axle whereby said mounting plate assembly rotates when said axle is rotated; and a ratchet mechanism fixedly coupled to said vertical upright member, said ratchet mechanism engaging said plurality of teeth whereby said axle rotates when said ratchet mechanism is operated; and said ratchet mechanism having an adjuster nut rotatable for operating said ratchet mechanism.

2. The engine stand of claim 1, further comprising:

a pair of bushings coupled to said vertical upright member, said axle passing through said bushings.

3. The engine stand of claim 1, further comprising:

said adjuster nut being rotatable in a first direction for rotating said mounting plate assembly in a clockwise direction, said adjuster nut being rotatable in a second direction for rotating said mounting assembly plate in a counter-clockwise direction.

4. The engine stand of claim 1, further comprising:

said ratchet assembly having a housing, said housing having a main portion, said ratchet assembly including a toothed rotatable ring positioned in said main portion of said housing, said adjuster nut being operationally coupled to said toothed rotatable ring;

said axle extending through an aligned pair of holes in said main portion of said housing such that said teeth are engaged by said toothed rotatable ring.

5. The engine stand of claim 4, further comprising:

said vertical upright member having a transverse tubular portion, said axle passing through said transverse tubular portion;

said housing having an arm portion extending from said main portion;

said arm portion having an aperture extending through said arm portion; and a bolt member insertable through said aperture and engagable to said vertical upright member, said aperture being offset from said transverse tubular portion of said vertical upright member when said ratchet assembly is coupled to said axle whereby said bolt member holds said housing in a static position relative to said upright vertical member.

6. The engine stand of claim 5, further comprising:

said adjuster nut being positioned on a side of said main portion of said housing.

7. An engine stand comprising:

a support stand having a wheeled base and a vertical upright member;

an axle extending through an upper portion of said vertical upright member, said axle having a first end and a second end;

said axle having a plurality of teeth extending along a portion of said axle, said teeth extending inwardly from said second end of said axle;

an adjustable mounting plate assembly adapted for coupling to an engine, said mounting plate assembly being fixedly coupled to said first end of said axle whereby said mounting plate assembly rotates when said axle is rotated; and a ratchet mechanism fixedly coupled to said vertical upright member, said ratchet mechanism engaging said plurality of teeth whereby said axle rotates when said ratchet mechanism is operated;

said ratchet mechanism having an adjuster nut rotatable for operating said ratchet mechanism;

a pair of bushings coupled to said vertical upright member, said axle passing through said bushings;

said adjuster nut being rotatable in a first direction for rotating said mounting plate assembly in a clockwise direction, said adjuster nut being rotatable in a second direction for rotating said mounting assembly plate in a counter-clockwise direction;

said ratchet assembly having a housing, said housing having a main portion, said ratchet assembly including a toothed rotatable ring positioned in said main portion of said housing, said adjuster nut being operationally coupled to said toothed rotatable ring;

said axle extending through an aligned pair of holes in said main portion of said housing such that said teeth are engaged by said toothed rotatable ring;

said vertical upright member having a transverse tubular portion, said axle passing through said transverse tubular portion;

said housing having an arm portion extending from said main portion;

said arm portion having an aperture extending through said arm portion;

a bolt member insertable through said aperture and engagable to said vertical upright member, said aperture being offset from said transverse tubular portion of said vertical upright member when said ratchet assembly is coupled to said axle whereby said bolt member holds said housing in a static position relative to said upright vertical member; and said adjuster nut being positioned on a side of said main portion of said housing.

* * * * *